United States Patent [19]

Champion et al.

[11] Patent Number: 4,466,731

[45] Date of Patent: Aug. 21, 1984

[54] ELECTROPHOTOGRAPHIC MACHINE WITH HIGH DENSITY TONER CONCENTRATION CONTROL

[75] Inventors: James R. Champion; Robert W. Pries, both of Longmont, Colo.

[73] Assignee: International Business Machines Corporation, Armonk, N.Y.

[21] Appl. No.: 388,810

[22] Filed: Jun. 16, 1982

[51] Int. Cl.[3] ..... G03G 15/00; G03G 15/08

[52] U.S. Cl. ..... 355/14 D; 355/3 DD; 355/14 R; 118/653; 118/663; 118/688; 118/691; 430/30

[58] Field of Search ..... 355/14 D, 3 DD, 14 R, 355/14 CH, 14 E; 118/663, 688, 691, 657, 653; 430/30

[56] References Cited

U.S. PATENT DOCUMENTS

| | | | |
|---|---|---|---|
| 3,788,739 | 1/1974 | Coriale | 355/17 |
| 4,179,213 | 12/1979 | Queener | 355/14 R |
| 4,183,657 | 1/1980 | Ernst et al. | 355/14 R |
| 4,326,796 | 4/1982 | Champion et al. | 355/14 CH |
| 4,348,099 | 9/1982 | Fantozzi | 355/14 D X |
| 4,377,338 | 3/1983 | Ernst | 355/14 D |

*Primary Examiner*—A. C. Prescott
*Attorney, Agent, or Firm*—C. E. Rohrer

[57] ABSTRACT

A toner concentration control test cycle in which a developed test area is formed on a photoconductor charged to a dark charge level. The optical reflectivity of the developed test area is sensed and the result used to replenish toner if indicated. During the test cycle, the magnetic brush bias potential is altered to produce development of the test patch in the gray area with the level of dark charge held constant at a predetermined nominal level. An electrostatic probe and associated circuitry are provided to maintain dark charge at the nominal level during the test cycle.

14 Claims, 9 Drawing Figures

ELECTROPHOTOGRAPHIC MACHINE WITH HIGH DENSITY TONER CONCENTRATION CONTROL

This invention relates to electrophotographic machines and more particularly to controlling the concentration of toner at high density levels.

BACKGROUND OF THE INVENTION

In electrophotographic machines, copies of documents or other subjects are produced by creating an image of the subject on a photoreceptive surface, developing the image, and then fusing the image to copy material. In machines utilizing plain bond copy paper or other ordinary image receiving material not specially coated, the electrophotographic process is of the transfer type where a photoreceptive material is placed around a rotating drum or arranged as a belt to be driven by a system of rollers. In a typical transfer process, photoreceptive material is passed under a stationary charge generating station to place a relatively uniform electrostatic charge, usually several hundred volts, across the entirety of the photoreceptive surface. Next, the photoreceptor is moved to an imaging station where it receives light rays which may be reflected from a document to be copied or generated by some type of light producing printhead. In the case of reflected light from a document, the white areas reflect large amounts of light thus discharging photoreceptive material to relatively low levels while black areas reflect little light causing the corresponding areas on the photoreceptive material to continue to carry high voltage levels even after the exposure. In that manner, the photoreceptive material is caused to bear a charged pattern which corresponds to the printing, shading, etc. present on the original document.

After receiving the image, the photoreceptor is moved to a developing station where a toning material is placed on the image. This material may be in the form of a black powder which carries a charge opposite in polarity to the charge pattern on the photoreceptor. Because of the attraction of the oppositely charged toner, particles of the toner adhere to the surface of the photoreceptor in proportions related to the shading of the original. Thus, black character printing should receive heavy toner deposits, white background areas should receive none, and gray or otherwise shaded half-tone character portions of the original should receive intermediate amounts.

The developed image is moved from the developer to a transfer station where copy receiving material, usually paper, is juxtaposed to the developed image on the photoreceptor. By placing a charge on the backside of the copy paper and stripping the paper from the photoreceptor the toner material is held on the paper and removed from the photoreceptor. After transfer, the paper is moved into a fuser where the toning material is permanently joined to the paper.

In the developing step outlined above, it has become common in contemporaneous machines for magnetic brush developing components to be used. In the typical magnetic brush developer, a rotating cylinder surrounds stationary magnetic rolls which attract magnetic material to the surface of the cylinder. That material is then carried to the development zone, where an electrical field is present due to the charge on the photoreceptive material. That charge attracts the oppositely charged toner to the surface of the photoreceptor as mentioned above. Since the toner is carried out of the machine on the surface of the paper, it is apparent that toner is a supply item which must be periodically replenished.

Additionally, in developer mixes where the toner is nonmagnetic, it must be mixed with carrier particles which are magnetic and oppositely charged to the toner. In such case, it is necessary to maintain an appropriate concentration of toner particles to carrier particles so that good development of the latent image is obtained.

While many methods for controlling the toner concentration in a developer mix have been invented, a particularly useful toner concentration control scheme is outlined in U.S. Pat. No. 4,183,657. In this scheme, a special test cycle is run wherein the photoconductor is charged by the charge corona to the customary dark voltage level but an exposure is not made at the exposure station. Instead, the interimage and edge erase lamps are utilized to erase all of the charge with the exception of a small stripe or patch that is located in the area of the photoconductor ordinarily used for the production of the latent image. That small patch is then developed at the developer and passed under a toner concentration control station where light rays are directed onto the developed patch and a photosensor senses the degree of reflectivity which results. That degree of reflectivity is then compared to the reflectivity of the bare photoconductor in the undeveloped areas of the latent image area with the result that a measure of the toner concentration on that particular photoconductor is obtained. In that manner, the quantity of toner in the developer mix can be adjusted to keep the toner concentration at a desired level.

Recently, the copier industry has begun to utilize higher optical densities in order to obtain copies with an improved quality appearance. Optical density is a measure of how black the development is and is a logarithmic scale produced from measurements taken with a reflectometer. In order to obtain higher optical densities, the amount of toner in the toner carrier ratio must be increased or different developer mix chemicals used, or multiple pass developer stations used. Whatever the technique of increasing optical density, problems are created in the toner concentration control scheme outlined above since high density development of the control patch produce burdens on the cleaning station and may create a situation where the optical sensor becomes insensitive to changes in toner density. This results if the optical sensor reaches the limit of its ability to sense changes in the optical density. For example, suppose that a control point is established that calls for the developed patch to produce thirty times less reflected light than the bare photoconductor. Suppose further that this ratio produces as black a patch as can be sensed. If during the course of machine use the control is readjusted to a level of, for example, 34 to 1 the sensing mechanism would call for increases in the concentration of toner. However, if the optical sensor is incapable of sensing changes above a ratio of 30 to 1, the desired toner concentration level of 34 to 1 will not be sensed. Consequently, toner will continue to be added into the developer mix and ultimately a level of 40 or 50 to 1 might be reached. As a consequence of too much toner in the developer mix, poor copy quality will result (high background), the cleaning station will be overloaded resulting in poor cleaning, and contamination of the machine will probably result. In order to remedy these problems, the inventors herein have adjusted the magnetic brush voltage level during the development of the toner concentration control patch so that development occurs at a gray level rather than at a black level. In one machine, for example, a gray patch is produced if the developer bias is at 450 volts, whereas black development occurs at 300 volts. In that machine, the required adjustment of developer bias voltage to 450 volts is accomplished during the test cycle.

Unfortunately, while sensing toner concentration levels in the gray area provides for decreased cleaning station burdens and provides for the required optical sensitivity, it produces another problem in that changes in dark voltage produce, proportionately, greater changes in toner concentration for a gray patch than for a black patch. To illustrate, suppose that a particular machine carries a nominal dark voltage of 860 volts, a nominal magnetic brush bias voltage of 300 volts, and a gray brush bias level of 450 volts. These parameters result in a black vector of 560 volts and a gray vector of 410 volts. In this situation, if changes in the charge corona power supply, corona contamination, or changes in the electrostatic sensitivity of the photoconductor result in a change in dark voltage, the sensitivity of the gray vector to that change substantially exceeds that of the black vector. As a consequence, the toner concentration level may be altered more quickly outside of a range of toner concentrations suitable for good development. For example, a particular concentration of 1% toner by weight might produce nominal development and a range of 0.9 to 1.1% might produce similar good development. However, if the patch test results in concentration outside of the appropriate range, development quality may decline or some other deleterious effect may take place, such as machine dusting with toner particles.

SUMMARY OF THE INVENTION

In the method and apparatus of this invention, a toner concentration control test cycle is run with a test patch produced, preferably in the area of the photoconductor ordinarily used for document reproduction. The magnetic brush bias level is altered during this test cycle so that development of the test patch is in the gray area rather than the black area and, in addition, the value of the dark charge potential is retained at a constant value through the use of an electrostatic probe to sense the level of dark charge and by controlling the charge corona power supply to produce the desired charge level during the test cycle.

BRIEF DESCRIPTION OF THE DRAWINGS

The above-mentioned and other features and objects of this invention and the manner of attaining them will become more apparent and the invention itself will best be understood by reference to the following description of embodiments of the invention taken in conjunction with the accompanying drawings, the description of which follows.

DETAILED DESCRIPTION a. In General

Figure 1:
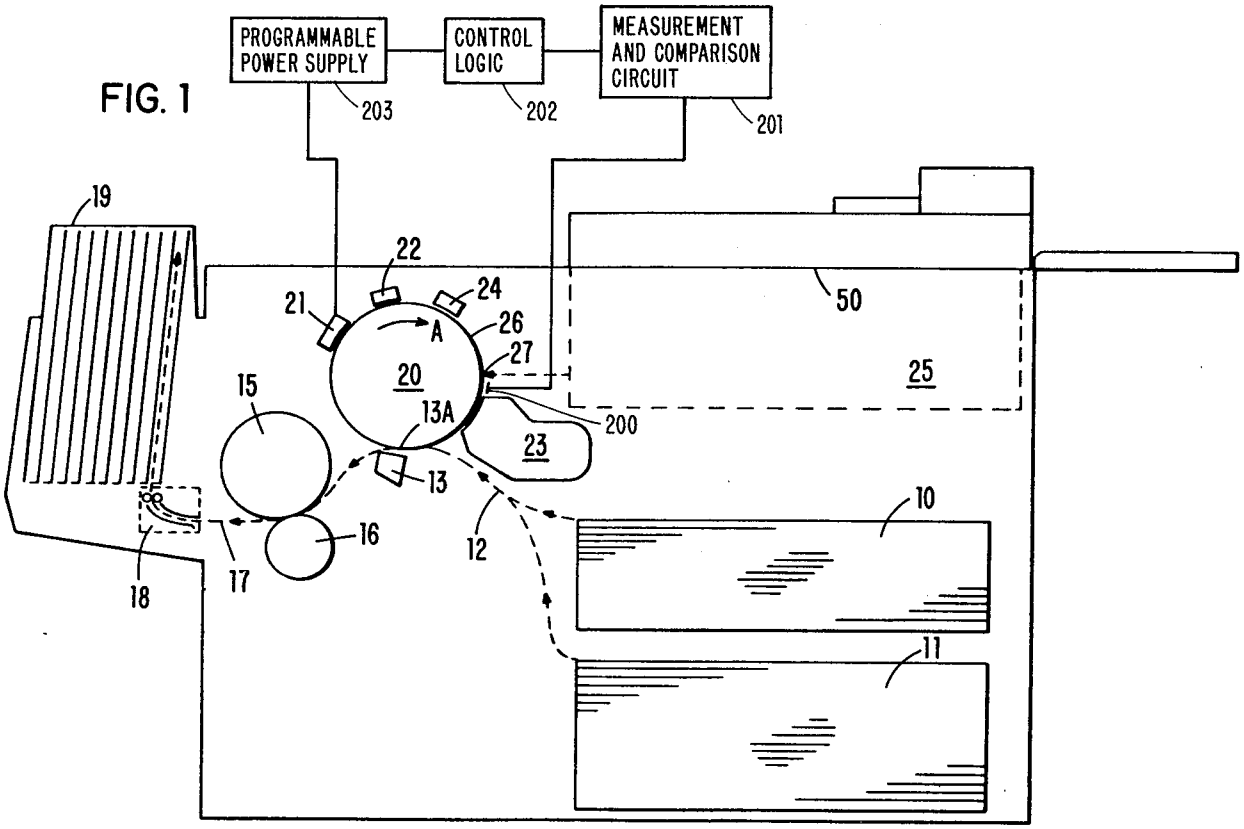
FIG. 1 shows an electrophotographic machine in which the invention is practiced.

FIG. 1 shows a typical electrophotographic machine of the transfer type. Copy paper is fed from either paper bin 10 or paper bin 11 along guides 12 in the paper path to a transfer station 13A located just above transfer corona 13. At that station an image is placed upon the copy paper. The copy paper continues through the fusing rolls 15 and 16 where the image is firmly attached to the copy paper. The paper continues along path 17 into a movable deflector 18 and from there into one of the collator bins 19.

In order to produce an image on the photoconductive surface 26, a document to be copied is placed upon a glass platen 50. An image of that document is transferred to the photoconductive surface 26 through an optics module 25 producing that image on the photoconductive surface 26 at exposure station 27. As the drum 20 continues to rotate in the direction A, developer 23 develops the image which is then transferred to the copy paper. As the photoconductor continues to rotate, it comes under the influence of preclean corona 22 and erase lamp 24 which discharge all of the remaining charged areas on the photoconductor. The photoconductor continues to pass around and through the developing station 23 (which is also a cleaning station in this embodiment) until it reaches the charge corona 21 where the photoconductor 26 is again charged prior to receiving another image at exposure station 27.

Figure 2:
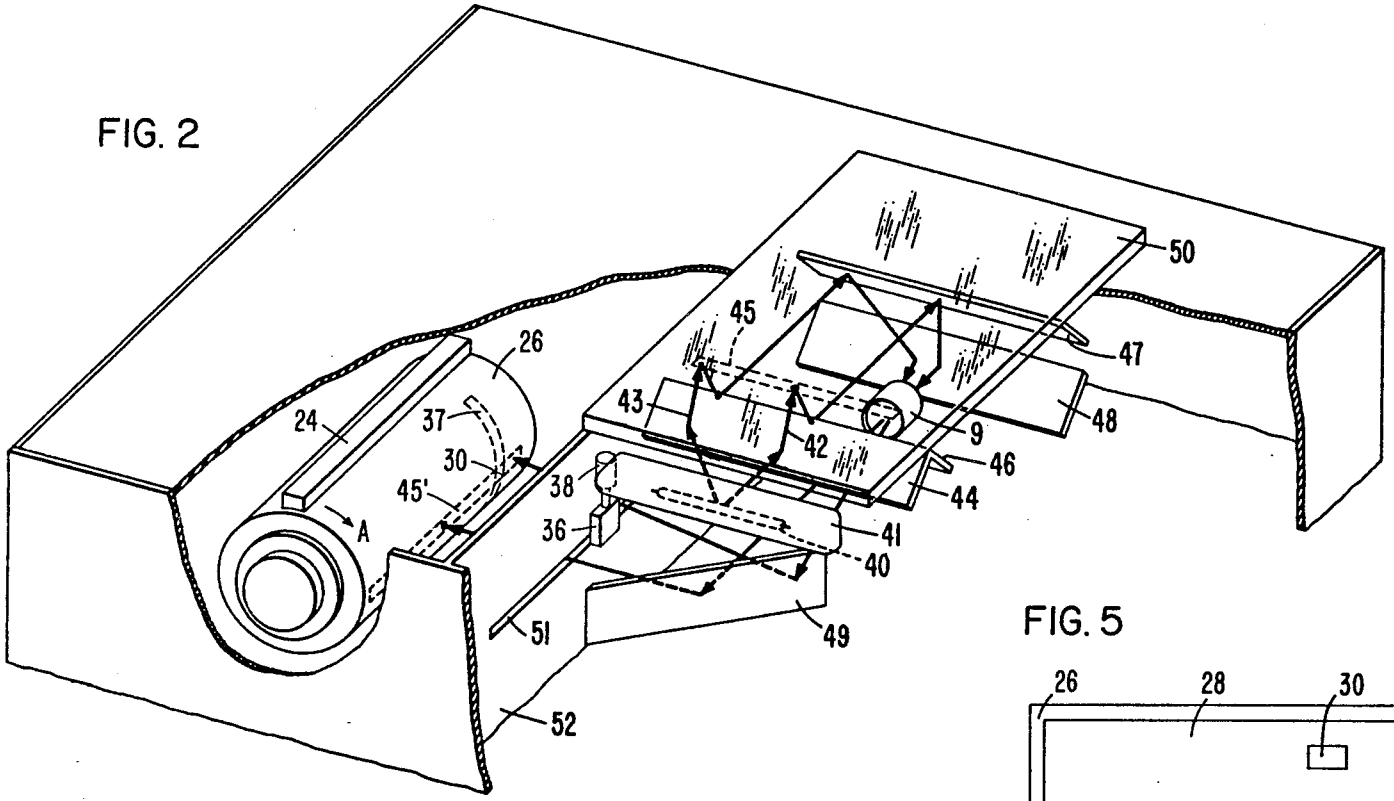
FIGS. 2 and 3 provide additional detail relating to the formation of a test patch within the machine of FIG. 1.

FIG. 2 is a perspective of the optics system showing the document glass 50 upon which the document to be copied is placed. An illumination lamp 40 is housed in a reflector 41. Sample light rays 42 and 43 emanate from lamp 40 and are directed from dichroic mirror 44 to the document glass 50 whereat a line of light 45 is produced. Sample light rays 42 and 43 are reflected from the document placed on the document glass to reflective surface 46; from there to reflective surface 47 to reflective surface 48 and thence through lens 9 to another reflective surface 49. From mirror 49, the light rays are finally reflected through opening 51 in wall 52 to reach photoconductor 26 whereat a line of light 45' is produced. In that manner, a replica of the information contained in the line of light 45 on the glass platen 50 is produced on the photoconductor 26 at 45'. The entire length of a document placed on document glass 50 is scanned by motion of lamp 40 and the mirrors 44, 46, 47 and 48. By traversing the line of light 45 across the document at the same speed at which the line of light 45' is moved across photoconductor 26 by rotation of drum 20, a 1:1 copy of the document can be produced on the photoconductor 26.

Figure 3:
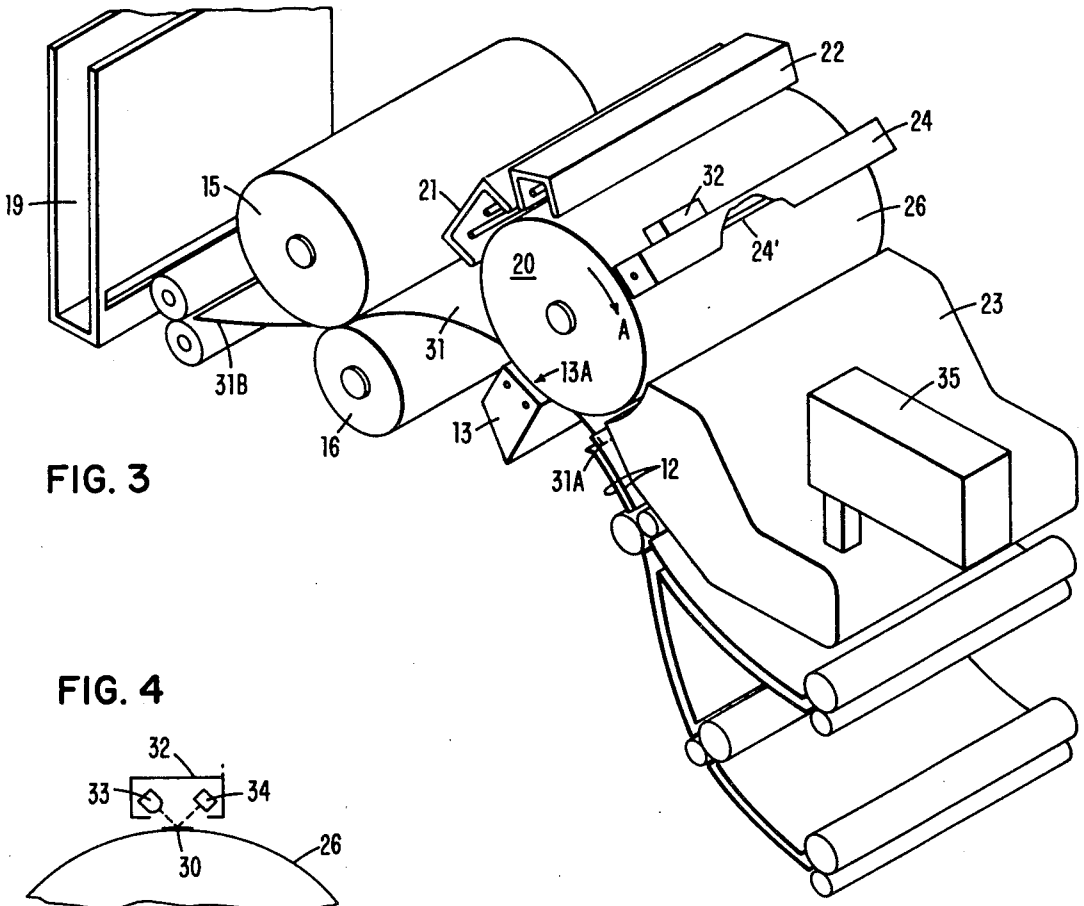

FIG. 3 shows the various elements in the paper path in perspective. Here a copy sheet 31 is shown with its trailing edge 31A in the paper path at guides 12. The copy paper is receiving an image at transfer station 13A and is in the process of having that image fused to itself by fuser rolls 15 and 16. The leading edge 31B of the copy paper is about to leave the document copier and proceed into the collator 19 which is represented in simplified form.

After an image is transferred to the copy paper, the photoconductor 26 continues to rotate until it comes under the influence of preclean corona 22 which applies a charge to the photoconductive surface to neutralize the remaining charge thereon. Photoconductor 26 continues to rotate until the photoconductor comes under the influence of an erase light 24' in housing 24. The erase light produces illumination across the entirety of the photoconductor 26 in order to complete the discharge of any remaining areas on the photoconductive surface which have not been neutralized by the preclean corona 22. After passing under erase lamp 24', the photoconductor continues through the cleaning station of developer/cleaner 23, wherein any remaining toner powder not transferred to copy paper is cleaned from the photoconductor prior to the beginning of the next copy cycle.

In the next copy cycle, the charge corona 21 lays down a uniform charge across photoconductor 26 which charge is variably removed when the image of the document is placed on the photoconductor at the exposure station 27 shown in FIG. 1. Preclean corona 22 and erase lamp 24' are off during this cycle.

When the toner concentration control cycle is run, and if the result indicates a need to add toner to the developer, a signal is sent to replenisher 35 which holds a supply of toner and operates to dump a measured amount into the developer. In that manner, the toner density of the developer mix is replenished. Any suitable replenisher mechanism may be used including the replenisher described in *IBM Technical Disclosure Bulletin,* Vol. 17, No. 12, pp. 3516, 3517.

b. The Test Cycle

Figure 4:
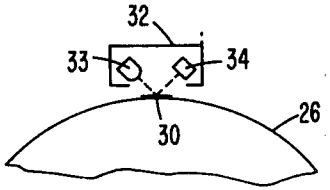
FIG. 4 shows a reflectivity sensing device in association with a test patch.
Figure 6:
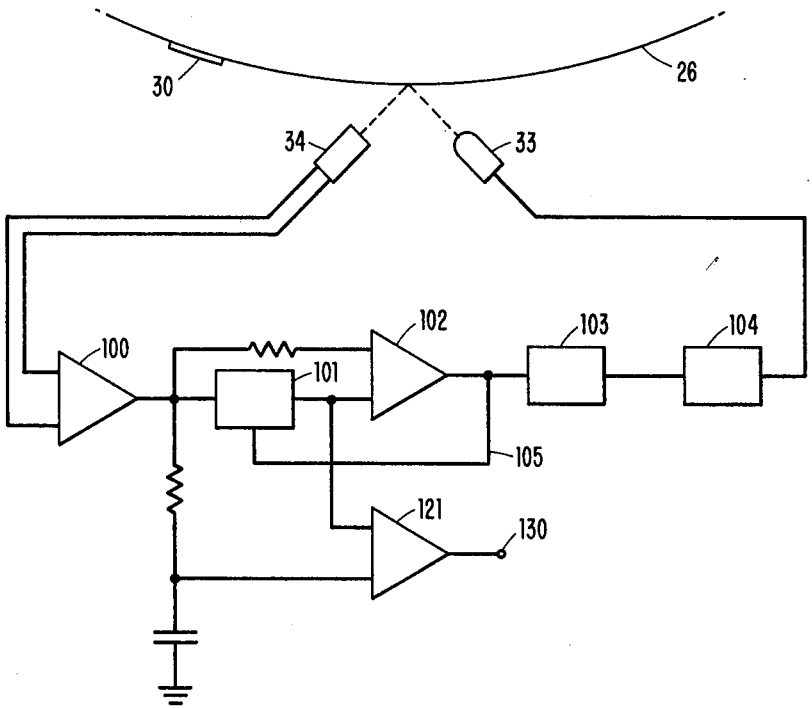
FIG. 6 shows a circuit for measuring reflectivity readings.

FIG. 3 shows a housing 32 containing the toner concentration control sensing system shown in FIGS. 4 and 6. When it is desired to sense for the concentration of toner in the developer mix, the photoconductor is charged as usual at the charge corona 21, but no image is placed on the charged photoconductor at exposure station 27. Instead, on this cycle, the erase lamp 24' remains on discharging all of the charge which has been laid down by charge corona 21 in order to provide bare photoconductor for a reference test area. However, the erase lamp 24' is momentarily interrupted to produce a charged stripe toned sample for a test area. If the lamp 24' is comprised of an array of light-emitting diodes, the array can be segmented such that only a few of the LED's are momentarily turned off and therefore only a small "patch" of charge remains on the photoconductor at the conclusion of this part of the cycle. If a fluorescent tube is used as the erase lamp 24', momentarily reducing its energization to a low level will produce a "stripe" of charge remaining on the photoconductor at the conclusion of this part of the cycle.

Whether a stripe of charge or a patch of charge is produced, the charged test area continues to rotate in the direction A until it reaches the developer 23 where toner is placed onto the charged area to produce a toned sample test area. No copy paper is present at transfer station 13A in the test cycle, thus allowing the developed test area to continue its rotation in direction A until it approaches the toner concentration control housing 32. At this point, referring now to FIG. 4, a light-emitting diode (LED) or other suitable light source 33 is energized to produce light rays which reflect off the toned sample test area 30 and are reflected to a photosensor 34. It should be noted that the toned image could be transferred to copy paper, if desired. The reflectance of the developed and transferred stripe (or patch) would then be sensed by locating sensors on the paper path. It should also be noted that the principles of this system work well with photosensitive paper, i.e., electrophotographic machines in which the image is exposed directly onto the copy paper rather than through a transfer station.

Figure 5:
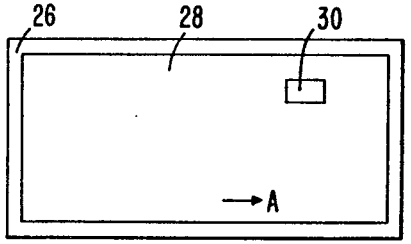
FIG. 5 shows the location of a test patch on a photoconductor.

FIG. 5 shows the layout of the photoconductor 26 with an image area 28 outlined therein. A developed patch 30 has been produced within the image area 28. FIG. 2 shows apparatus for producing patch 30. As described above, erase lamp 24' is momentarily interrupted to produce a stripe of charge. While the above description designated 45' as a light producing an image on photoconductor 26, suppose now that during the test cycle the line or stripe 45' is used to designate a stripe of charge produced by momentarily interrupting lamp 24'. Suppose also that document lamp 40 is turned on during the test cycle so that light from lamp 40 will erase the stripe of charge 45' unless it is interrupted. Such an interruption is made possible by the provision of shutter 36 which is shown in FIG. 2 as dropping across slot 51 in wall 52. Shutter 36 is actuated by solenoid 38. As a result, light from lamp 40 is blocked away from photoconductor 26 by shutter 36, thus producing a stripe of charge 37. Of course, erase lamp 24' will erase all of stripe 37 except for patch 30. In that manner, a patch instead of a stripe can be produced. Note that slot 51 should be positioned close to the photoconductive surface 26.

c. The Toner Concentration Control Circuit—FIG. 6

FIG. 6 shows a circuit designed to control the density of a toned patch on the photoconductor such that the reflectance ratio of toned-to-untoned photoconductor remains constant. Density control is achieved by adjusting the toner concentration in the developer mix with the ultimate goal to maintain constant output copy density.

The circuit senses the reflectance of the photoconductor continuously with the light-emitting diode 33 producing a continuous output. Thus, as the various images are produced and developed on the photoconductive surface 26, the transducing elements 33 and 34 will continually sense the density level of those images and produce corresponding responses in the circuit network shown in FIG. 6. However, the output signal will not be sensed during ordinary image production since it is only interrogated by the machine control during a quality control test cycle.

During the quality control test cycle, LED 33 and photosensor 34 sense the untoned reflectance of the base photoconductive surface to produce a signal which is amplified by circuit 100 and stored in sample circuit 101. This untoned reflectance reference signal is stored automatically when the toned sample patch 30 passes across the photosensor 34 and, after a short time delay, the LED output 33 is automatically increased so that the toned photoconductor reflectance signal is approximately equal to the reference signal. The stored reference signal and the adjusted sample signal are compared and if the density of patch 30 is at a proper level, this comparison will be approximately equal and result in no output signal. If, however, the density of patch 30 has decreased, the output signal of the comparator will produce an output to cause the replenisher 35 to add toner to the developer mix contained in the reservoir of developer 23.

Figure 7:
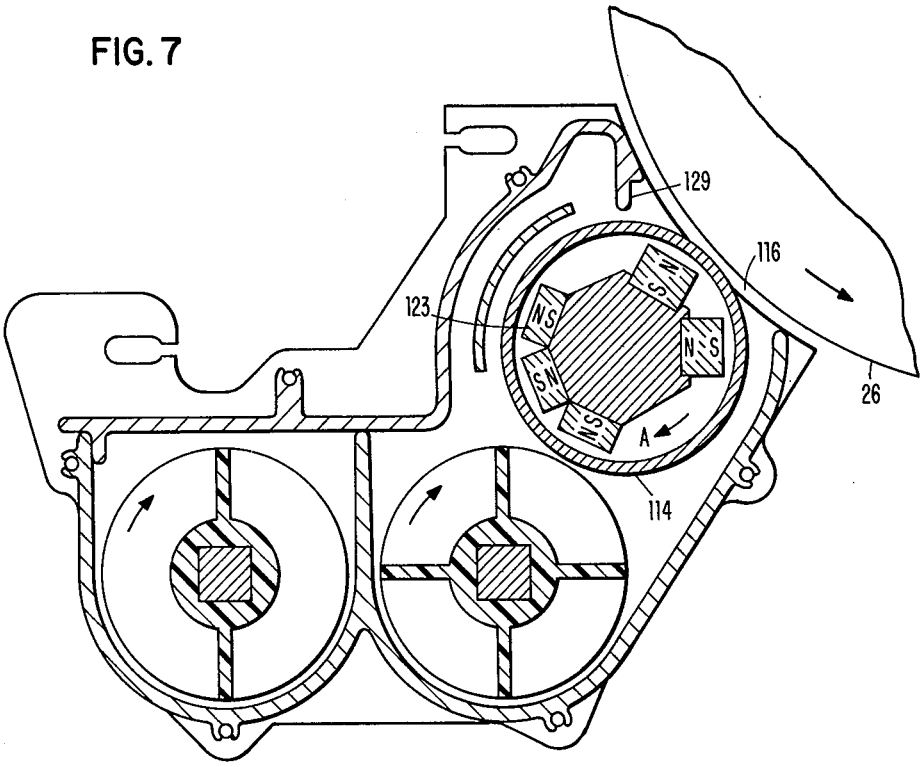
FIG. 7 shows a developer for use in the machine of FIG. 1.

The circuit of FIG. 6 operates in the following manner: Photosensor 34 senses the reflectance level of the bare photoconductor 26 and produces a certain output which is fed into the amplifier 100. The output of amplifier 100 is detected by detector 102 and fed to the current driver 103. The output of current driver 103 adjusts the current source 104 such that the LED 33 produces the light output to drive the circuit to a steady state condition indicative of untoned bare photoconductor. During the operation of the circuit, the voltage level output of amplifier 100 is stored in the sample circuit 101. When the toned sample patch 30 passes across the LED 33 and photosensor 34, the reflectance level suddenly changes resulting in a much lowered output from amplifier 100. This much lowered output is detected at 102 and causes the reference voltage in sample circuit 101 to be stored through line 105 which disconnects the storage elements in circuit 101 from the amplifier 100. The much lowered output of detector 102 also causes the current driver 103 to drive the current source 104 to produce a much higher current level to energize the LED 33 to a level which drives the input to amplifier 100 to a level equal to approximately the previous reference input. The detailed implementation of FIG. 6 is shown in FIG. 7 of application Ser. No. 219,122, assigned to the assignee of the instant invention, now under allowance, and incorporated herein by reference.

d. Magnetic Brush Developer

FIG. 7 shows the magnetic brush developer which is used with the machine illustrated in FIG. 1. This developer is the subject of U.S. Pat. No. 4,161,923. FIG. 7 shows a number of magnets 123 located within a cylinder 114 which rotates in the direction A. As the cylinder rotates, magnetic particles in the developer mix are attracted to the rotating cylinder and moved in direction A past doctor blade 129 into the developing zone 116. In the developing zone, toner particles which are charged oppositely to the charge on photoconductor 26 are attracted to photoconductor 26 and develop the latent image thereon.

e. The Development Process

Figure 8:
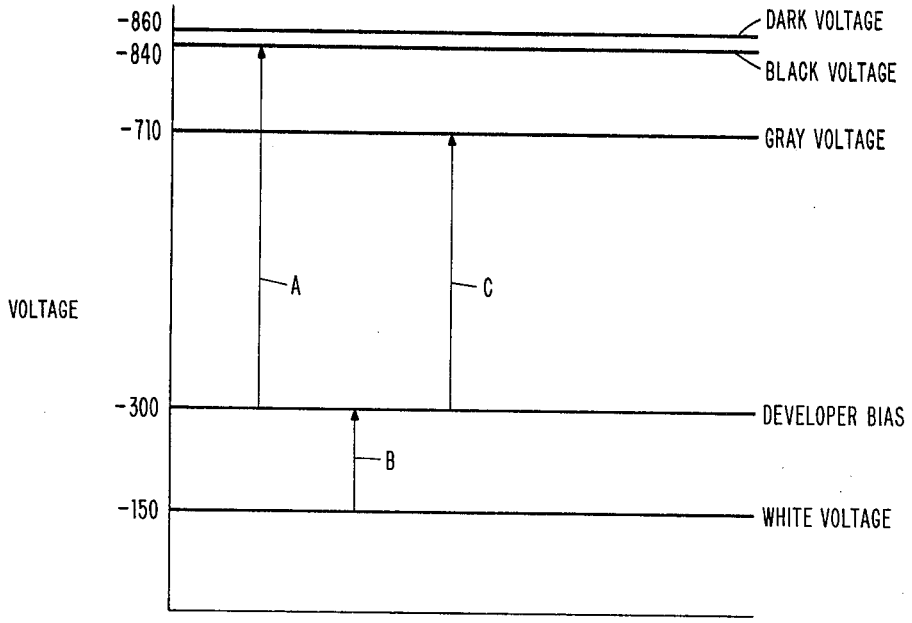
FIGS. 8 and 9 show representative voltage vectors during development.

FIG. 8 illustrates the manner in which development occurs. In a machine such as shown in FIG. 1, the photoconductor is charged by charge corona 21 to a level of approximately 860 volts. This level is termed the dark charge. When a document is exposed, the white areas of that document reflect a considerable amount of light which discharges the photoconductor to a level of approximately 150 volts. This level is termed the white charge. Black areas of the document theoretically would not discharge the photoconductor at all but in fact there is a slight discharge of the photoconductor from 860 volts to a level of about 840 volts. This level is termed the black charge.

In the developing zone 116, FIG. 7, positively charged toner is attracted to the areas of the photoconductor which are charged negatively. In order to prevent the toner from being attracted to the white charge of −150 volts, a bias voltage is placed on the magnetic brush cylinder 114 at a level of −300 volts. As a consequence, in those areas of the photoconductor which are discharged to −150 volts, the positively charged toner is attracted back to the magnetic brush developer shell 114 rather than to the photoconductor under the influence of the white vector B. In that manner, the white charge areas of the photoconductor remain relatively free of toner particles. However, the 300 volt charge on the developer is considerably lower than the black charge of −840 volts and therefore a considerable black vector is developed as shown at A, approximately 540 volts, which attracts the toner from the magnetic brush developer toward the black charge areas of the photoconductor. To develop a gray area, note that the photoconductor is discharged to a level of about −710 volts, thus producing a gray vector C of 410 volts.

Figure 9:
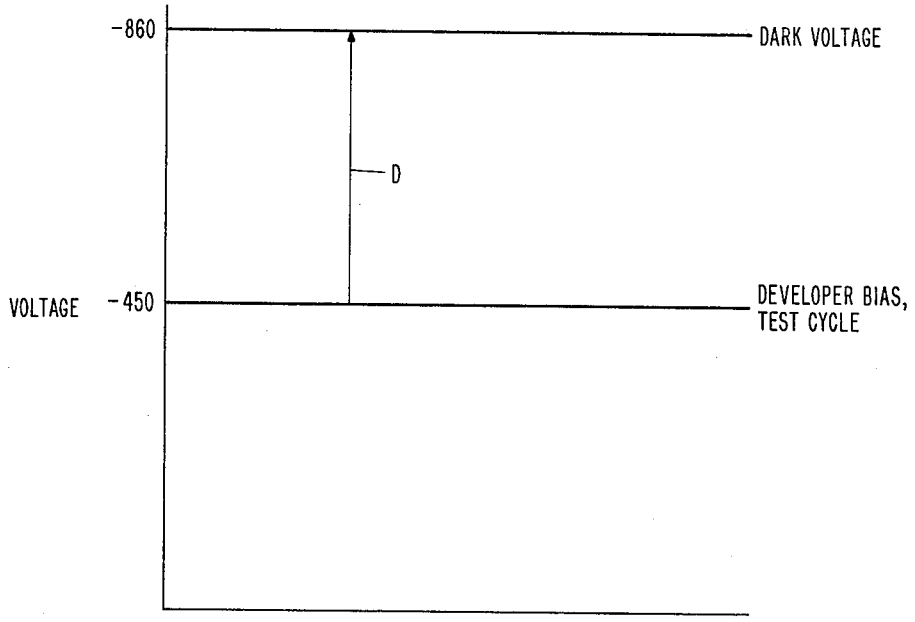

When a toner concentration control test is in operation, exposure of a document does not occur and the entire photoconductor surface is discharged except for the patch 30, FIG. 5, which retains a charge approximately equal to the dark charge level of −860 volts. In accordance with the invention, the magnetic brush bias voltage is increased on this test cycle to −450 volts, thus establishing a vector D, as shown in FIG. 9, of 410 volts to attract toner to the patch. The vector D of 410 volts, being considerably lower than the black vector A, causes the patch 30 to develop out at a gray intensity level.

In order to keep the value of the toner concentration control vector at a level which is unaffected by changes in the value of the dark voltage, the dark voltage is held constant during the toner concentration control cycle. In order to accomplish this control, an electrostatic probe 200 is located near the surface of photoconductor 26 as shown in FIG. 1. This probe, and the circuit 201, together with control logic 202 and programmable power supply 203 may be similar to those items described in U.S. Pat. No. 4,326,796 to Champion et al. which patent is incorporated herein by reference.

Figure 10:
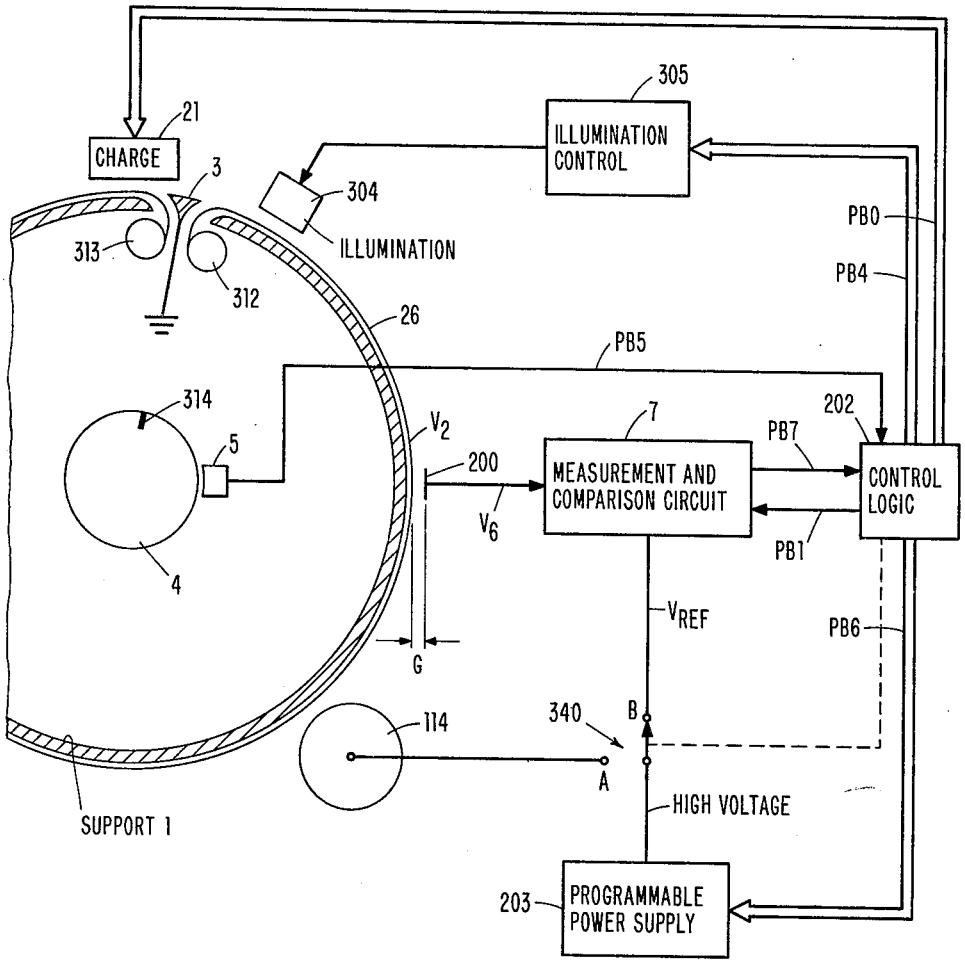
FIG. 10 shows a circuit for controlling dark charge by use of an electrostatic probe.

FIG. 10, similar to FIG. 1 of the Champion patent shows an electrostatic probe 200 located near the surface of photoconductor 26, which is carried on a support 1. The support 1 may take any form desired (for example a flat surface) and the photoconductor 26 need not be configured as shown (for example it may comprise a flat belt). In another variation, the support may carry a document coated with a chargeable surface functioning in place of the photoconductor. In the particular embodiment shown for illustration, the support 1 is circular so that the photoconductor 26 may be advanced to present a fresh surface by movement of reels 312 and 313. Since the point at which the photoconductor 26 enters the support 1 to contact the reels 312 and 313 cannot remain open to contaminants, one or more seals 3 are provided. In the embodiment shown, the support 1 is a conductive material as is the seal 3. The support 1 and the seal 3 are connected to a reference potential, for example ground. It is not essential that either or both the support 1 and seal 3 be connected to ground or to the same reference potential. The position of the seal 3 is externally indicated by an emitter wheel 4 carrying one or more indicia marks 314 which may be sensed by a sensor 5. Thus, in FIG. 10, a signal appears on the bus PB5 whenever the mark 314 indicates that the support 1 portion carrying the seal 3 is in a line with the sensor 5.

Toner or other developer may be applied to the photoconductor 26 surface by a magnetic roller 114 held at a potential by programmable power source 203 when a switch 340 is in position A. It will be understood that the switch 340 is only illustrative of a function which supplies a continuous (but adjustable) potential to magnetic roller 114 when in position A, while independently providing an adjustable potential to another circuit, such as a measurement and comparison circuit 7 when in position B. The switch 340 may be placed in either position A or position B by a control line 10 connected to control logic 202. The function of switch 340 can be performed by, for example, two separate power supplies, one power supply with two separately adjustable outputs, etc. As is well known in the art, if the magnetic roller 114 rotates, a "magnetic brush" of developer particles will form and wipe across the photoconductor 26 surface. It is not essential to this invention that this particular technique be employed; however, it is desirable, for the purpose of the invention, that the amount of developer applied to the photoconductor 26 surface be determinable by a conveniently changeable variable such as a voltage from power supply 203. Also in the vicinity of the support 1 is provided a charge control device 21 capable of charging the photoconductor 26 to a desired potential for purposes of development, cleaning or other copier process functions. The only requirement of the invention is that there be some convenient technique of controlling the copier process by changing variables. The charge device 21, which can for example be a corona, provides a convenient example of this sort of device, as does the magnetic roller 114. Similarly, there is shown an illumination device 304 which may be used to provide initial copier illumination tion or which may be utilized for a variety of noncopy (such as discharge) purposes. An illumination control 305 is illustrative of a general technique of controlling illumination device 304. Note that the illumination device may be a printhead for use in a printer environment or a document lamp 40, FIG. 2, in a copier environment. Each of the devices 114, 304 and 21 may be controlled by signals on corresponding busses PB6, PB4 and PBO.

Control logic 202 interconnects the signals from the sensor 5, the switch 340, and input/output ports via line 10 and control busses PB0, PB1, PB4, PB5, PB6 and PB7. When the mark 314 is lined up with the sensor 5, a signal on bus PB5 enables the control logic 202 to provide selected data signals to the programmable power supply 205 and to desired ones of the illumination control 305 and charge device 21 to make a desired adjustment at that time. The amount of adjustment required depends upon the charge detected on the photoconductor 26 in accordance with principles well known in the art of electrophotography.

The adjustment depends upon detection of the charge on the photoconductor 26 in an accurate and consistent manner. Probe 200, spaced a distance G from the surface of the photoconductor 26, forms one plate of a capacitor connected to measurement and comparison circuit 7. The other plate of the capacitor is formed by adjacent conductive material, whether it be the support 1 or the seal 3. In the example shown, as the support 1 passes beneath the probe 6, a potential charge is stored in the capacitor formed by the support 1 and the probe 200 as a function of the area of the probe, its spacing G and the material therebetween. The potential E between a capacitor's plates is given in Sears and Zemansky, "College Physics, Part 2," page 452 (Addison-Wesley 1948) as:

$$E=1/K\epsilon_O\, gd/A$$

where K is the dielectric coefficient of material between the plates, d is their spacing, A their area, q the charge in either plate and $\epsilon_O$ the permitivity of empty space. In the case shown in the figure for a given spacing G, the dielectric constant and photoconductor 26 charge determine the potential at the probe 200. Inasmuch as the dielectric constant will remain the same, (for a given environment, transient or permanent), the probe 200 will assume a potential $V_6$, or a particular charge level as determined by the photoconductor 26 potential $V_2$, or the charge level thereon.

As the seal 3 passes under the probe 200, a reference, independent of the photoconductor 26 charge, is sensed by the probe 200. Assuming that the seal 3 is at a known potential (preferably ground), probe 200 is thereby initialized to a known charge or potential level enabling accurate sensing of photoconductor 26 charge levels or potentials thereafter. If a seal 3 is not provided, some other reference may be provided; for example, a discrete area on the photoconductor 26 may be radically discharged.

The charge across the probe 200 will not be significantly affected, during sequential cycles of operation, by small movements of the probe 200 or by contaminants. The measurement and comparison circuit 7 thus may accurately measure photoconductor 26 charge levels in order to indicate to the control logic 202, on bus PB7, corrections necessary to bring the copier process within desired limits. The control logic 202 signals the measurement and comparison circuit 7, on bus PB1, when a series of sensing operations may begin.

To illustrate operation of the invention, assume that the measurement and comparison circuit 7 senses that the probe 200 potential $V_6$ or the charge level has decreased relative to a reference voltage $V_{Ref}$(because the illumination value has changed, that potential available to the charge device 21 has changed, etc.). Then, the measurement and comparison circuit 7 will indicate on bus PB7 an error signal when signaled by the control logic 202 on bus PB1. With switch 340 in position B, the control logic 202 then adjusts the programmable power supply 203 to supply different voltages $V_{Ref}$to the measurement and comparison circuit 7 until the error signal approaches zero. The voltage $V_{Ref}$ may be used, directly (for example by changing switch 340 to position A) or indirectly (for example the illumination control 305 or charge device 21 may be adjusted until the measurement and comparison circuit 7 indicates, during the subsequent measurement, that the probe 200 potential $V_6$ or the charge level has returned to a predetermined desired level relative to $V_{Ref}$).

The description of the probe and its associated circuitry should be understood as illustrative. For example, in a machine with a continuous photoconductor, some other type of probe would be necessary in order to initialize the probe circuit. Many vibrating probes are known to those of skill in the art and that type of probe together with its associated circuitry could be used to sense the photoconductor dark voltage on sense patch 30 in order to provide the needed data to control corona 21 to achieve a constant dark charge during the toner concentration control test cycle.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A method for maintaining toner concentration in an electrophotographic copier machine comprising the steps of:

charging the photoconductor to a particular dark voltage level and sensing the dark voltage level to which said photoconductor is charged;

adjusting said dark voltage level to a predetermined value;

adjusting developer bias voltage to a predetermined level in relation to the adjusted dark voltage level in order to produce development of said photoconductor with a predetermined constant voltage difference between said dark voltage level and said bias voltage level, said constant voltage difference being of a magnitude to produce a predetermined gray level upon development when toner concentration is nominal;

developing said photoconductor to produce gray toner density level;

sensing the density of said gray toner level; and adjusting toner concentration in accordance with the sensed density.

2. The method of claim 1 wherein said density sensing step includes optically sensing the reflectivity of bare photoconductor and comparing the reflectivity of the developed photoconductor in order to determine the density of development.

3. The method of claim 2 wherein said density sensing step occurs on a special quality control test cycle in which documents are not produced and in which the bare and developed photoconductor form a part of that portion of the photoconductor ordinarily used for document production.

4. The method of claim 3 in which said bare photoconductor is produced by erasing said dark voltage level across the photoconductor except for a test patch area used for development to said gray density level.

5. The method of claim 1 in which said step of sensing the dark voltage level includes the use of a conductive plate to form a capacitor with said charged photoconductor to produce a voltage level on said plate and adjusting a power supply used in conjunction with charging means in accordance with said voltage level on said plate to drive said dark voltage level to a predetermined value.

6. The method of claim 5 wherein said density sensing step includes optically sensing the reflectivity of bare photoconductor and comparing the reflectivity of the developed photoconductor in order to determine the density of development.

7. The method of claim 6 wherein said density sensing step occurs on a special quality control test cycle in which documents are not produced and in which the bare and developed photoconductor form a part of that portion of the photoconductor ordinarily used for document production.

8. The method of claim 7 in which said bare photoconductor is produced by erasing said dark voltage level across the photoconductor except for a test patch area used for development to said gray density level.

9. Apparatus for controlling the concentration of toner in a toner/carrier mix for use in an electrophotographic machine comprising:

a photoconductor;

a charging means for producing a dark charge voltage level on said photoconductor;

a first sensing means for sensing said dark charge voltage level;

first adjusting means for changing said dark charge voltage level to a predetermined value;

a developing mechanism with a bias electrode;

second adjusting means for setting the voltage level on said bias electrode to produce a predetermined voltage difference between said adjusted dark charge voltage level and said bias electrode voltage level to produce development of said photoconductor to a developed density level below a black intensity level and above a white intensity level;

second sensing means to sense said developed density level; and operating means to adjust the level of toner concentration for use with said second sensing means in said mix in accordance with said developed density level.

10. The apparatus of claim 9 further including erasing means to discharge said dark charge voltage level over the entire photoconductor except for a test area used for development to said developed density level.

11. The apparatus of claim 10 further including control means to operate said electrophotographic machine to produce output prints or copies and to operate said machine in a quality control cycle during which prints or copies are not produced and in which cycle said test area is produced in that portion of said photoconductor ordinarily used for print or copy production.

12. The apparatus of claim 9 wherein said first sensing means include a conductive plate means located adjacent to said photoconductor to form a capacitor therewith, said plate means connected to an adjustable power supply which is connected to said charging means.

13. An electrophotographic machine for producing copies or prints comprising:

a photoconductor;

means for moving said photoconductor through said machine;

control means for controlling said movement;

charging means under control of said control means for charging said photoconductor;

electrostatic probe means under control of said control means for sensing the charge on said photoconductor;

adjusting means connected to said probe means for causing said charging means to charge said photoconductor to a predetermined level;

a mix of the toner and carrier for use in developing said charged photoconductor;

developer means including a development electrode means for developing said charged photoconductor by depositing toner thereon; and power supply means for adjusting voltage levels on said development electrode to a special quality control level different from the level used for production development for controlling toner concentration in said mix.

14. The machine of claim 13 further including second optical sensing means under control of said control means for sensing the toner density of the development of said charged photoconductor and replenishment means under control of said control means for adjusting toner concentration in said mix in accordance with results obtained from said second sensing means.

* * * * *